United States Patent [19]

Lindahl

[11] 4,029,543

[45] June 14, 1977

[54] MECHANICALLY FREEING WOOD FIBERS IN THE PRESENCE OF SPENT PEROXIDE BLEACHING LIQUOR

[75] Inventor: Jonas Arne Ingvar Lindahl, Domsjoverken, Sweden

[73] Assignee: Mo och Domsjo, Ornskoldsvik, Sweden

[22] Filed: May 28, 1976

[21] Appl. No.: 691,171

Related U.S. Application Data

[63] Continuation of Ser. No. 478,198, June 11, 1974, abandoned, which is a continuation of Ser. No. 312,447, Dec. 6, 1972, abandoned.

[30] Foreign Application Priority Data

Dec. 14, 1971 Sweden ..... 15973/71

[52] U.S. Cl. ..... 162/24; 8/111; 162/26; 162/37; 162/40; 162/71; 162/78; 241/15; 241/28

[51] Int. Cl.[2] ..... D21B 1/16; D21C 9/16

[58] Field of Search ..... 162/24, 26, 37, 40, 162/55, 71, 78, DIG. 8; 8/111; 241/15, 28

[56] References Cited

UNITED STATES PATENTS

| | | | |
|---|---|---|---|
| 2,413,583 | 12/1946 | Shearer | 162/78 |
| 2,453,566 | 2/1948 | Adams et al. | 162/78 X |
| 3,423,283 | 1/1969 | Goodwald et al. | 162/78 X |
| 3,694,309 | 9/1972 | Gierer et al. | 162/78 |

FOREIGN PATENTS OR APPLICATIONS

| | | | |
|---|---|---|---|
| 622,852 | 6/1961 | Canada | 162/78 |

*Primary Examiner*—Arthur L. Corbin

[57] ABSTRACT

A process for the preparation of a cellulose pulp by mechanically freeing wood fibers in a grinder to form a fibrous pulp and bleaching the fibrous pulp with a peroxide-containing bleaching agent, as the only bleaching agent, in a peroxide bleaching stage, the mechanical freeing of the fibers being carried out in the presence of a spent liquor from the peroxide bleaching stage have a pH of 7 to 9.

5 Claims, 1 Drawing Figure

Figure 1:
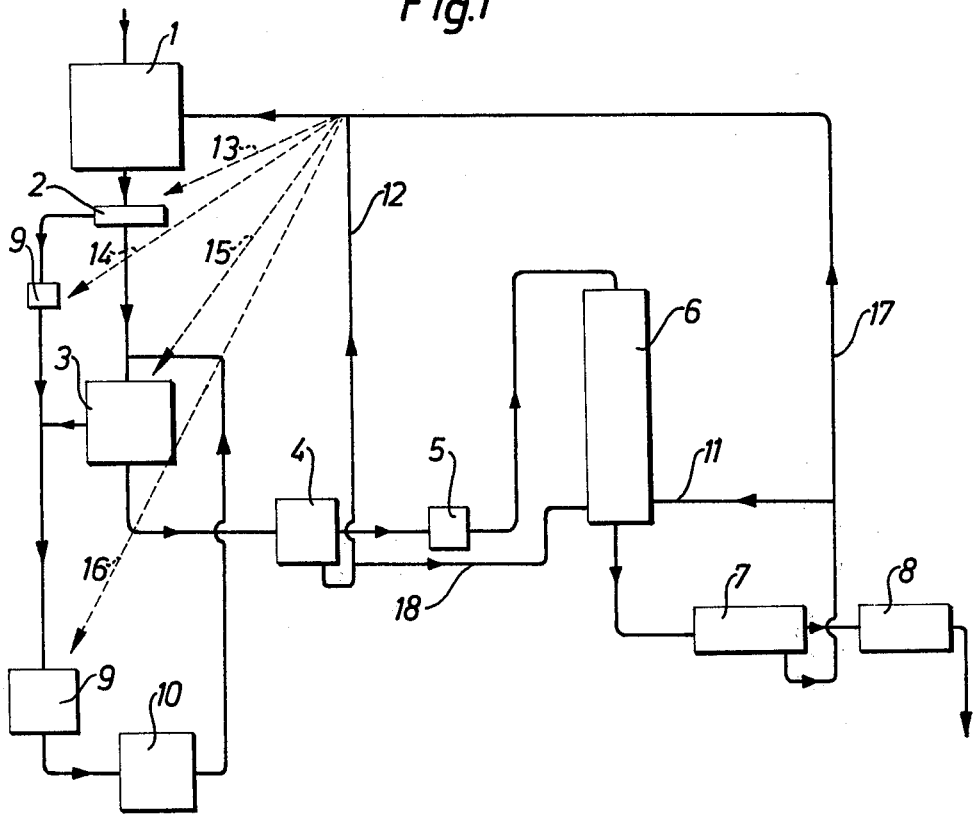

MECHANICALLY FREEING WOOD FIBERS IN THE PRESENCE OF SPENT PEROXIDE BLEACHING LIQUOR

This is a continuation, of application Ser. No. 478,198 filed June 11, 1974, and now abandoned which in turn is a continuation of Ser. No. 312,447 filed Dec. 6, 1972, and now abandoned.

The present invention relates to a process for the preparation of peroxide-bleached, mechanical cellulose pulps of improved brightness and strength. The expression "mechanical pulp" in this application means pulps, which are prepared by freeing the fibers of the wood without using any chemical digestion of the raw material in yields of from about 90 to about 98 percent of the wood. Such a mechanical freeing of the fibers is provided for instance by bringing the wood in the form of roundwood into contact with the surface of a rotating grindstone (groundwood) or grinding the wood in the form of chips in a disc refiner (refiner pulp). One further type of mechanical freeing can also be made in a so called "frotapulper", which is an apparatus principally consisting of two screws, which knead the wood material which is present in the form of large splinters, knots etc. In mechanical freeing of the fibers the pulp will contain all components of the original wood with the exception of the water soluble material.

Such mechanical pulps usually have very good properties as regards bulk, opacity and printing properties, but their area of use is limited by the relatively low brightness (57-65percent SCAN) and low strength (breaking length about 2,900m, tear factor about 33). By bleaching with peroxide or peroxide and dithionite it has been possible to increase the brightness to about 75–80 percent SCAN, but the problem of the low strength remains.

The present invention relates to a process for the preparation of peroxide-bleached mechanical pulps without the above mentioned disadvantages and resulting in pulps of high brightness and good strength at the same time as the consumption of bleaching chemicals is strongly reduced. The pulps prepared according to the present invention have such good properties that they have considerably increased the field of use of mechanical pulps.

The process of the invention is characterized by the fact that, when preparing pulps in high yields by mechanical freeing of the fibers and bleaching of the fibrous pulp obtained with peroxide, the mechanical freeing of the fibers is carried out in the presence of only spent liquor from the peroxide bleaching step, said liquor having a pH higher than 7.

The effect obtained according to the present invention - that is high brightness, improved strength and decreased consumption of chemicals — is very surprising, since it is well known at bleaching with hydrogen peroxide and dithionite that the recovery of spent liquor from the bleaching operation has to be combined with a neutralization with $SO_2$ to pH 5–6 because of the sensitivity of the dithionite for oxidation and the optimal bleaching effect of the dithionite at the pH mentioned and because of the fact that it has not been possible to obtain any increased strength using hydrogen peroxide only for bleaching.

Suitable peroxide bleaching agents according to the invention are sodium peroxide, hydrogen peroxide and peracetic acid but it is also possible to use other technically useful peroxide bleaching agents. Especially useful for the process of the invention is hydrogen peroxide.

The spent bleaching liquor used according to the invention shall have a pH higher than 7. Preferably the pH should be higher than 8 and especially suitable is a pH between 8 and 9. Useful as spent bleaching liquors are especially the bleaching chemicals-containing back waters, which are obtained when the pulp after bleaching and possible diluting with back water is dewatered on a wet-lap forming machine or other dewatering apparatus. This back water, which, also contains a certain amount of heavy metal complexing acids has in peroxide bleaching usually a pH of from 8 to 9 and it is especially suitable if the pH is about 8.5. The content of bleaching chemicals in the back water usually is the following:

| | g/l |
|---|---|
| peroxide | 0.2–0.8 |
| $Na_2SiO_3$ (buffer) | 1.0–3.0 |
| ethylenediaminetetra-acetic acid (complexing agent) | 0.05–0.12 |

It is understood that also other types of spent liquors from the bleaching process than the back waters mentioned above can be used according to the present invention.

The addition of bleaching agents is preferably combined in peroxide bleaching with an addition of complexing agents for heavy metals such as for instance aminocarboxylic acids of the general formula:

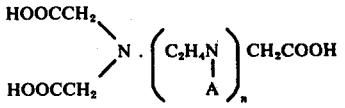

or alkali metal or magnesium salts thereof, in which formula A is the group — $CH_2COOH$ or — $CH_2CH_2OH$ and $n$ is an integer from 0 to 5. Examples of such acids are ethylenediaminetetraacetic acid (EDTA), nitrilotriacetic acid (NTA), diethylenetriaminepentaacetic acid, ethylenediaminetriacetic acid, tetraethylenepentaamineheptaacetic acid, hydroxyethylenediamine triacetic acid and their alkali metal salts, including mono, di, tri, tetra and penta sodium, potassium and lithium salts thereof. Also other types of aminocarboxylic acids, such as iminodiacetic acid, 2-hydroxyethyliminodiacetic acid, cyclohexane-diaminetetraacetic acid, anthranil-N,N-diacetic acid and 2-picolylamine-N,N-diacetic acid may be used. Especially suitable complex formers for use in the bleaching chemicals according to the present invention are ethylenediaminetetraacetic acid and diethylenetriaminepentaacetic acid.

Examples of heavy metal organic complexing acids, which may be present in the spent bleaching liquor are aliphatic alpahydroxycarboxylic acids of the type RCHOHCOOH and corresponding betahydroxy-carboxylic acids with the formula $RCHOHCH_2COOH$, in which formula R is hydrogen or an aliphatic radical, which may be a hydrocarbon radical with from one to ten carbon atoms or a hydroxy substituted hydrocarbon radical with from one to nine hydroxyl groups and from one to ten carbon atoms, such as glycolic acid, lactic acid, 1,2-dihydroxypropionic acid alpha, beta-dihydroxybutyric acid, beta-hydroxy-n-valeric acid and sugar acids and aldonic acids, such as gluconic acids, galactonic acid, mannonic acid and saccharinic acid.

To the peroxide bleaching chemicals it is also possible to add magnesium compounds, which decrease the degradation of the cellulose under the oxidation process. Examples of such magnesium compounds are magnesium oxide, magnesium hydroxide, magnesium carbonate, magnesium chloride, magnesium nitrate, magnesium acetate, magnesium sulphate and magnesium complexes with any of the complex forming acids mentioned above. The magnesium compounds may be added in an amount corresponding to 0.01 to 0.05 percent calculated as MgO based on the dry weight of the pulp.

Complexing agents and magnesium salts may be added together with the bleaching chemicals, but it is especially suitable to add them at an earlier stage in the process, e.g. after the pulp has passed the screening department and before the dewatering to a pulp concentration of at least about 10 percent, which occurs before the admixture of the bleaching chemicals.

The spent bleaching liquor used may be added wholly or partly at the mechanical freeing process at one or more locations, closely situated to the mechanical working station. Consequently all or part of the spent liquor may be added at the grinding plant, where the wood is disintegrated against grinding stones, whilst adding water, or chips are defribated in a disc refiner. A suitable method is to add spent liquor also to the pulp after the grinding plant, when the pulp has been coarsely screened, but before the primary screening department, where the pulp is treated in pressure screens and hydrocyclones. It is also possible to add spent liquor in the primary screening department itself. Furthermore a part of the spent liquor may be added during debarking. In FIG. 1 the dotted arrows 13, 14, 15 and 16 show some of the different stages in the process, where spent bleaching liquor can be reintroduced. It is advantageous also to add a part of the spent liquor to the rejects, which are obtained from the coarse screening process and the primary screening department and which is further treated in refiners and rejects-screening departments at any stage of the working process.

Mechanical pulp having a pulp consistency of 1 percent and obtained in the primary screening department is according to the present invention carried to a dewatering device, e.g. a filter, where the pulp is dewatered to a pulp consistency of 10–25 percent. Thereafter the bleaching chemicals are mixed in, usually in a high consistency pump or a mixing device working with screws after which the pulp is pumped to a bleaching tower. According to the present invention the bleaching chemicals must only contain peroxide as active bleaching agent. The bleaching chemicals have the following approximate composition and pH:

| | kgs/t of dry pulp |
|---|---|
| peroxide, e.g. 100 percent hydrogen peroxide | 32–40 |
| $Na_2SiO_3$ 40° Be (buffer) | 45–85 |
| NaOH, 100 percent | 14–24 |
| Ethylenediaminetetraacetic acid 40 percent (complexing agent) | 2–6 |
| pH before addition to the pulp | 10.5–11.5 |
| pH after addition to the pulp | 9.8–10.8 |

It is advantageous to add the complexing agent before the dewatering process that is carried out before the bleaching.

The above particulars show that the amount of peroxide added according to the invention is considerably lower than the normal amount (about 45 kgs per ton of dry pulp in order to obtain the highest amount of brightness). This means a considerable decrease in cost. Also the addition of complexing agent and buffer will according to the present invention be lower than the normal.

In the bleaching tower the pulp is bleached at a temperature of about 45° C to 65° C under a time period of from about 2 hours to about 5 hours. After the bleaching has been carried out the pulp is diluted, preferably with back water to a pulp consistency of about 3 percent after which it is introduced on the wet-lap forming machine, where it is dewatered to a pulp consistency of about 50 percent. Back water leaving the wet machine is transferred as mentioned above to the mechanical working process. The pulp may after bleaching, if desired, also be dewatered without preceding dilution and the back water thereby obtained can be used in accordance with what is stated above.

The invention is illustrated by the following examples:

Groundwood pulp was prepared in a plant as schematically shown in FIG. 1 by grinding groundwood in grinders in the grinding plant 1 against rotating pulp stones under hydraulic pressure of the wood against the stone. During the grinding back water from the bleaching department was sprayed against the surfaces of the stones. The pulp obtained was coarsely screened on a vibration screen 2 and was thereafter passed through a primary screening department 3 with pressure screens and hydrocyclones. It had a pulp concentration of 0.5–1.0 percent. A complexing agent, ethylenediaminetetraacetic acid (EDTA), was then added. After the primary screening department the pulp was dewatered on a suction filter 4 to a pulp concentration of about 13 percent. Back water leaving the suction filter was led back to the grinding plant and the screening department. The pulp was then mixed with bleaching chemicals (hydrogen peroxide, sodium silicate and sodium hydroxide) in a high consistency pump 5 and pumped to the upper part of the bleaching tower 6. The addition of bleaching chemicals was:

| | | |
|---|---|---|
| $H_2O_2$, 100 percent, | kgs per ton of dry pulp | 45 |
| $Na_2SiO_3$, 40° Be | " | 80 |
| NaOH, 100 percent | " | 21 |
| EDTA, 40 percent | " | 8 |

The pH was 10–10.5 when the pulp entered the bleaching tower and about 8.5 when the pulp left after the bleaching process.

The passage of the pulp through the bleaching tower took about 3 hours. At the bottom of the bleaching tower the pulp was diluted with back water from the suction filter 4 and the wet-lap machine 7 through the pipes 11 and 18 to a pulp consistency of about 3 percent. The bleached pulp was then concentrated to a pulp concentration of 50 percent on a wet-lap machine 7 and flake dried in a flake drying machine 8.

From the wet-lap machine 7 back water containing bleaching chemicals having the composition

| | |
|---|---|
| hydrogen peroxide | 0.5 g/l |
| $Na_2SiO_3$ | 2.5 g/l |
| EDTA | 0.08g/l |

was led back to the grinding plant 1. The pH of the back water was 8.5.

Rejects from coarse screening and primary screening department were treated in disc refiners 9, screened in a rejects screening department 10 and led back to the primary screening department.

Applying the present invention samples were taken partly at starting up of the plant according to the above scheme, when the amount of chemicals in the back water led back was zero, partly after 16 hours, when balance had been obtained. 6 hours after the start the amount of peroxide was decreased to 36 kgs per ton of dry pulp, which corresponds to the smaller consumption according to the present invention. Brightness, fiber composition and strength were determined for the samples taken and the results thereof are shown in Table I:

Table I

| PROCESS | STATE OF ART | INVENTION |
|---|---|---|
| $H_2O_2$, 100 percent, kgs per t dry pulp | 45 | 36 |
| Brightness according to SCAN, percent | 80 | 80 |
| Freeness according to Canadian standard, mls | 97 | 103 |
| Breaking length, m | 2830 | 3780 |
| Tear factor | 33.0 | 38.3 |
| Burst factor | 12.8 | 16.5 |
| Fractionation according to Bauer Mc Nett: | | |
| Fibers not passing filter 20 mesh | 5.1 | 6.2 |
| Fibers not passing filter 150 mesh | 57.2 | 62.4 |
| Fibers passing filter 150 mesh | 37.7 | 31.4 |

The results show that the presence of spent bleaching liquor at the grinding and at the refining of coarse pulp, obtained after screening, improves the brightness and strength of the mechanical pulp. The figures for the fractionation show also that the amount of O-fibers (fibers that pass a screen of the size 150 mesh) is greatly decreased using the present invention.

Though it has not been possible to give a full explanation of the good results obtained it is possible that the lower consumption of peroxide may partly depend on the fact that the wood is bleached by the residual peroxide contained in the spent bleaching liquor and partly on the fact that residual peroxide is led back to the bleaching tower according to the present invention. One further factor of importance may be the presence of organic complexing acids in the spent bleaching liquor fed back, which acids will reduce the catalytic effect on the degradation of the peroxide caused by heavy metals present, and which also reduce the attack on the cellulose. Analyses of the pulps prepared according to Example 1 at a constant addition of complexing agent give the following contents of heavy metals:

| | mg metal per kg of dry pulp | | |
|---|---|---|---|
| | Fe | Mn | Cu |
| Conventional process | 34.1 | 6.6 | 1.2 |
| Process of the Invention | 20.3 | 4.7 | 0.7 |

Samples taken from the unbleached pulp immediately before the mixing with bleaching chemicals show that the process of the invention also increases brightness for the pulp obtained from the primary screening department. At the conventional process the brightness was 64.3 percent SCAN, whereas the pulp prepared according to the invention had a brightness of 70.2 percent SCAN.

I claim:

1. In the process for the preparation of a cellulose pulp by mechanically freeing wood fibers in a grinder to form a fibrous pulp, and bleaching the fibrous pulp in a peroxide bleaching stage by adding a peroxide-containing bleaching agent, as the only bleaching agent, to said fibrous pulp the improvement which comprises mechanically freeing the wood fibers in a separate step preliminary to said bleaching, in the presence of only spent bleaching liquor from said peroxide bleaching stage, said liquor having a pH within the range from 7 to 9.

2. The process of claim 1, in which the peroxide-containing bleaching agent is hydrogen peroxide.

3. The process of claim 2, in which the pH of the spent liquor is higher than 7.5.

4. The process of claim 3, in which the pH of the spent liquor is 8 to 9 .

5. The process of claim 1, in which one part of the spent liquor also is added to the fibrous pulp after the grinder but before the addition of the bleaching agent.

* * * * *